US007451715B2

(12) United States Patent
Koop et al.

(10) Patent No.: US 7,451,715 B2
(45) Date of Patent: Nov. 18, 2008

(54) ACTIVE ROLL STABILISATION SYSTEM FOR SHIPS

(75) Inventors: Mattheus Theodorus Koop, Oud-Turnhout (BE); Lambertus Johannes Maria Dinnissen, Eindhoven (NL); Johannes Ooms, Nootdorp (NL)

(73) Assignee: Quantum Controls B.V. (NL)

( * ) Notice: Subject to any disclaimer, the term of this patent is extended or adjusted under 35 U.S.C. 154(b) by 0 days.

(21) Appl. No.: 11/549,254

(22) Filed: Oct. 13, 2006

(65) Prior Publication Data

US 2007/0272143 A1 Nov. 29, 2007

Related U.S. Application Data

(60) Provisional application No. 60/801,129, filed on May 17, 2006.

(51) Int. Cl.
*B63B 39/06* (2006.01)

(52) U.S. Cl. ..... 114/126

(58) Field of Classification Search ..... 114/126
See application file for complete search history.

(56) References Cited

U.S. PATENT DOCUMENTS

| | | | | |
|---|---|---|---|---|
| 2,979,010 | A * | 4/1961 | Braddon et al. | 114/126 |
| 3,687,100 | A | 8/1972 | Larsh | |
| 3,756,262 | A | 9/1973 | Morrow et al. | |
| 3,757,723 | A | 9/1973 | Pangalila | |
| 3,818,959 | A | 6/1974 | Larsh | |
| 4,599,964 | A * | 7/1986 | Kenney et al. | 114/124 |
| 4,777,899 | A | 10/1988 | Bettcher, Jr. | |
| 5,171,623 | A | 12/1992 | Yee | |
| 5,186,420 | A * | 2/1993 | Beauchamp et al. | 244/219 |
| 5,445,095 | A | 8/1995 | Reed et al. | |
| 6,978,728 | B2 | 12/2005 | Koop et al. | |
| 2005/0145151 | A1 * | 7/2005 | Koop et al. | 114/126 |

FOREIGN PATENT DOCUMENTS

| | | |
|---|---|---|
| EP | 0754618 A1 | 1/1997 |
| GB | 893054 | 4/1962 |
| GB | 922977 | 4/1963 |
| WO | WO 97/02641 | 1/1997 |

* cited by examiner

*Primary Examiner*—Stephen Avila
(74) *Attorney, Agent, or Firm*—Hovey Williams LLP

(57) ABSTRACT

The invention relates to an active roll stabilization system for ships, including at least one stabilization element extending below the water line, which is mounted on a rotary shaft that extends through the ship's hull, a sensor for sensing the ship's movements and delivering control signals on the basis thereof to rotation member for rotating the rotary shaft for the purpose of damping the ship's movements that are being sensed through the stabilization element.

The object of the invention is to provide an active roll stabilization system for ships that can be used both with ships which are underway and with ships that are at anchor. According to the invention, the active roll stabilization system is to that end wherein the stabilization element is provided with a sub-element that is movable with respect to the stabilization element. This makes it possible to impart an additional lifting moment to the ship via the stabilization element, both while the ship is sailing and while the ship is at anchor, for the purpose of effectively damping or countering the ship's movements that are being sensed.

22 Claims, 9 Drawing Sheets

ACTIVE ROLL STABILISATION SYSTEM FOR SHIPS

RELATED APPLICATIONS

This application claims the benefit of U.S. Provisional Patent Application No. 60/801,129, filed May 17, 2006, incorporated by reference herein.

BACKGROUND OF THE INVENTION

The invention relates to an active roll stabilisation system for ships, comprising at least one stabilisation element extending below the water line, which is mounted on a rotary shaft that extends through the ship's hull, sensor means for sensing the ship's movements and delivering control signals on the basis thereof to rotation means for rotating the rotary shaft for the purpose of damping the ship's movements that are being sensed by means of the stabilisation element.

Such an active roll stabilisation system for ships is known, for example from U.S. Pat. No. 3,818,959, the disclosure of which is incorporated herein by reference. In said US patent it is proposed to impart a reciprocating rotary motion to a fin-like stabilisation element that projects into the water from the ship's hull below the waterline so as to compensate for the rolling motions that the ship undergoes while sailing. To that end, the ship is fitted with sensor means, for example angle sensors, speed sensors and acceleration sensors, by means of which the angle, the rate of roll or the roll acceleration are sensed. Control signals are generated on the basis of the data being obtained, which signals control the direction of rotation and the speed of rotation of the stabilisation element via the rotation means. Another example of a sensing means is a rate gyroscope, as shown in U.S. Pat. No. 3,756,262, the disclosure of which is incorporated hereby by reference, and also a pendulum-type sensor as shown in U.S. Pat. No. 4,777,899, the disclosure of which is incorporated herein by reference.

A reaction force acting on the water can be generated by means of said fin-like stabilisation element while sailing, which reaction force imparts a counteracting lifting or torsional moment to the ship, which is to counter the ship's roll, if the stabilisation element is correctly controlled.

A drawback of the stabilisation system according to said US patent is the fact that it is fairly static as regards the control thereof and that it can only be used while the ship is sailing. The above-described lifting effect does not occur, or not to a sufficient extent, while the ship is stationary, because there is no functional water movement past the stabilisation elements, and consequently there can be no effective roll stabilisation.

SUMMARY OF THE INVENTION

The object of the invention is therefore to provide an active roll stabilisation system for ships that can be used both with sailing ships and with ship that are at anchor. According to the invention, the active roll stabilisation system is to that end wherein the stabilisation element is provided with a sub-element that is movable with respect to the stabilisation element. This makes it possible to impart an additional lifting moment to the ship via the stabilisation element, both while the ship is sailing and while the ship is at anchor, for the purpose of effectively damping or countering the ship's movements that are being sensed.

In a functional embodiment, the sub-element is pivotable about a sub-pivot, whilst the sub-pivot may extend parallel to the rotary shaft. In another effective embodiment, the sub-element may be slidably accommodated in a space formed in the stabilization element.

In a further embodiment the sub-element is pivotably connected with the stabilisation element.

Furthermore according to the invention the sub-element is slidable in a direction parallel to the longitudinal axis of the ship, whereas in another embodiment the sub-element is slidable in a direction transverse to the longitudinal axis of the ship.

To achieve a more effective damping of the ship's movements being sensed, the sub-element is capable of movement independently of the rotary motion of the stabilisation element.

The sub-element may have a curved shape or a wing shape, in a specific embodiment it is made of a flexible material.

According to the invention, one embodiment of the active stabilisation system is wherein the rotation means comprise at least one piston-cylinder combination, said piston being connected to the rotary shaft. Also other rotation means, such as rotation actuators or an electrical driving mechanism may be used, however.

More specifically, the rotation means comprise two piston-cylinder combinations, each piston being connected on either side of the longitudinal direction of the rotary shaft to a yoke mounted to the shaft end that extends into the ship's hull. Said latter construction provides a more reliable control of the stabilisation element and thus a more functional damping of the ship's movements that are being sensed.

In another functional embodiment, drive means are present for driving the sub-element, which drive means are at least partially accommodated in the stabilisation element. The rotary shaft may be of hollow construction, and the drive means may also comprise a hinging drive shaft, that is carried through said hollow, rotary shaft.

In another embodiment, on the other hand, the drive means comprise a linkage accommodated in the stabilisation element, which linkage is connected to the sub-element on the one hand and to the hinging drive shaft on the other hand.

The above aspects provide a simple, robust yet reliable driving mechanism for the sub-element.

In another embodiment, the drive means comprise at least one extension element accommodated in the stabilisation element, which is connected to the sub-element, for extending and retracting the sub-element.

The extension element may form part of a spindle driving mechanism of a piston-cylinder combination.

More specifically, according to the invention the position of the sub-element with respect to the stabilisation element is adjustable in dependence on the speed of movement of the ship.

The invention also relates to a method for active roll stabilisation of ship through the use of an active stabilisation system according to the invention, which method comprises the steps of:

A) sensing the ship's movements

B) delivering control signals on the basis thereof for rotating the rotary shaft for the purpose of C) damping the ship's movements that are being sensed by means of the stabilisation element. According to the invention, the method is further characterized by the steps of:

D) measuring the speed of the ship in the direction of travel; and

E) adjusting the position of the sub-element with respect to the stabilisation element on the basis of the speed measured in step D).

BRIEF DESCRIPTION OF THE DRAWINGS

The invention will now be explained in more detail with reference to a drawing, in which.

For easy reference, like parts will be indicated by the same numerals in the description of the figures below.

DETAILED DESCRIPTION OF THE DRAWINGS

Figure 1:
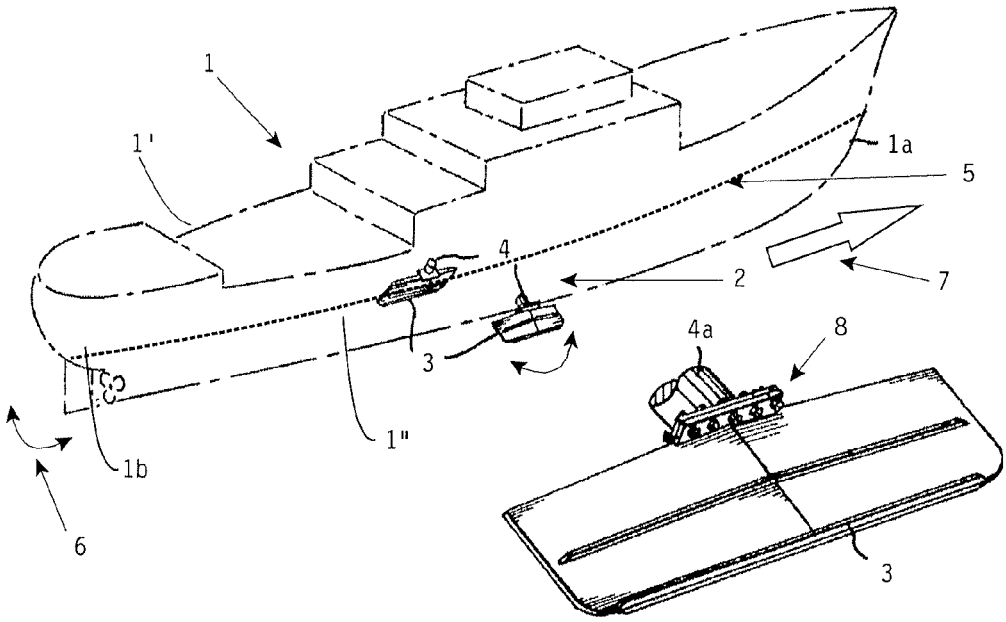
FIG. 1 shows a ship fitted with an active stabilisation system according to the prior art.

FIG. 1 shows an active stabilization device according to the prior art. A ship 1 having a stem 1*a* and a stern 1*b* is fitted with an active stabilization device indicated at 2. This known active stabilization device 2 for ship's movements as described in U.S. Pat. No. 3,818,959 is built up of two stabilization elements 3, which project from the ship 1 on the port side 1' and on the starboard side 1", respectively, below the water line 5.

To that end, each stabilization element 3 is mounted, whether or not by means of a flange 6 (see the partial view of the stabilization element in FIG. 1), to the shaft end 4*a* of a shaft 4 extending from the ship's hull 1*c*, which can be rotated by the rotation means 9.

The active stabilization system 2 according to the prior art is also provided with one or more sensors, a sensor means schematically illustrated as 8, which sense the ship's movements and more in particular the ship's roll as indicated at 6. On the basis thereof, control signals are delivered to the rotation means 9, such as electric motors, or motors coupled to pumps which are fluidically coupled to one or a pair of piston and cylinder assemblies, which rotate the stabilization elements 3 via the rotary shafts 4 (depending on the stabilization correction that is to be carried out). The sensor means may consist of angle sensors, roll speed sensors and acceleration sensors, which continuously sense the angle of the ship 1 with respect to the horizontal water surface 5, the speed or the acceleration effected by the rolling motions 6.

The active stabilization system as shown in FIG. 1 is intended for damping ship's movements while the ship is sailing (indicated at 7 in FIG. 1). The interaction between the rotating stabilization element 3 and the water flowing past results in a reaction force or lifting moment opposed to the rolling movement 6 of the ship 1. The rolling movement 6 of the ship 1 can be corrected by means of said lifting moment and the resulting reaction forces.

One drawback of the known active stabilization device 2 is the fact that it can only be used with ships while sailing and to a limited, not very effective degree with ships that are substantially stationary ("at anchor"). It is in particular with the latter group of ships (for example chartered ships that lie at anchor in a bay for prolonged periods of time) that the present invention can be suitably used.

Figures 2A, 2B:
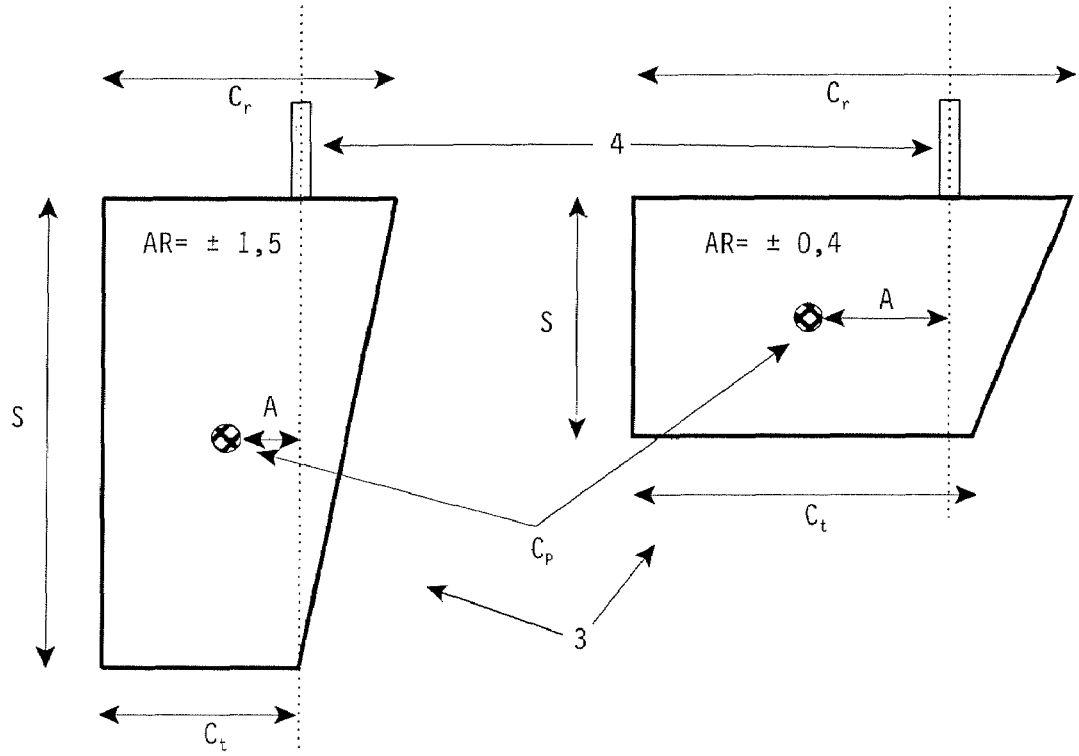
FIGS. 2A and 2B show two embodiments of stabilisation elements according to the prior art.

FIGS. 2A and 2B show two embodiments of stabilization elements 3 according to the prior art. As already explained with reference to FIG. 1, a fin or stabilization element 3 projecting under the ship, being rotatable about a shaft 4, is used for effectively damping the ship's roll imparted to the ship 1 by the waves while the ship is sailing. As the stabilization element 3 reciprocates about its axis of rotation 4, a reaction force is generated by the water flowing past while the ship is sailing, which reaction force, provided the movement of the stabilization element is properly controlled, generates a counteracting moment to counter the ship's roll.

The constructional dimensions of the stabilization element 3 determine the effectiveness of the stabilization element, i.e. the effect of the stabilization element moving through the water. More in particular, to obtain a maximum effective stabilization effect while is sailing, it is desirable to select a maximum ratio between the width and the length of the stabilization element, the so-called Aspect Ratio (AR). This implies that the width of the stabilization element must be much greater than the length thereof, as is shown in FIG. 2A, so that the turning moment of the stabilization element 3 will be small while sailing and the stabilization element can be quickly reciprocated through the water, using little energy/power.

While the ship is stationary, the interaction between the stabilization element and the water flowing past (while sailing) is absent, so that the counteracting lifting moment does not occur. It is desirable, therefore, to select a minimum value for the Aspect Ratio between the width and the length of the stabilization element while the ship is stationary. This means that the length of the stabilization element must be much greater than the width thereof, as is shown in FIG. 2B. During stabilization, as much water as possible is "scooped" or moved during the movement of the stabilization element 3 through the water, thus generating a counteracting lifting moment.

The Aspect Ratio (AR) of a stabilization element according to the prior art is defined by:

$$AR = \frac{S}{\left(\frac{C_r + C_t}{2}\right)}$$

wherein:

AR=the Aspect Ratio

S=the width of the stabilization element $C_t$=the smallest length of the stabilization element $C_r$=the greatest length of the stabilization element As for the time being the stabilization elements shown in FIG. 1 will be used for stabilizing the ship's roll while sailing, considering the current state of the art, it must be attempted to find an optimum Aspect Ratio between the two stabilization situations (the ship sailing and the ship being stationary).

From a viewpoint of effectiveness it is desirable to use a stabilization element 3 having a high AR ratio while sailing, whereas a stabilization element 3 having a low AR is preferred while the ship is stationary. This can be explained by the fact that the moment required for turning or rotating the stabilization element about the shaft 4 is higher in the case of a stabilization element having a high AR than in the case of a stabilization element 3 having a low AR.

The turning moment of the stabilization element is determined in part by the distance A (the moment arm) of the center of pressure $C_p$ of the forces that act on the stabilization element. The distance or arm A between the axis 4 and the center of pressure $C_p$ of a stabilization element having a high AR (see FIG. 2A) is smaller than that of a stabilization element having a low AR (see FIG. 2B).

From a viewpoint of functionality it is desirable, therefore, to design a stabilization element that can be used both while the ship is sailing and while the ship is stationary.

Figure 3:
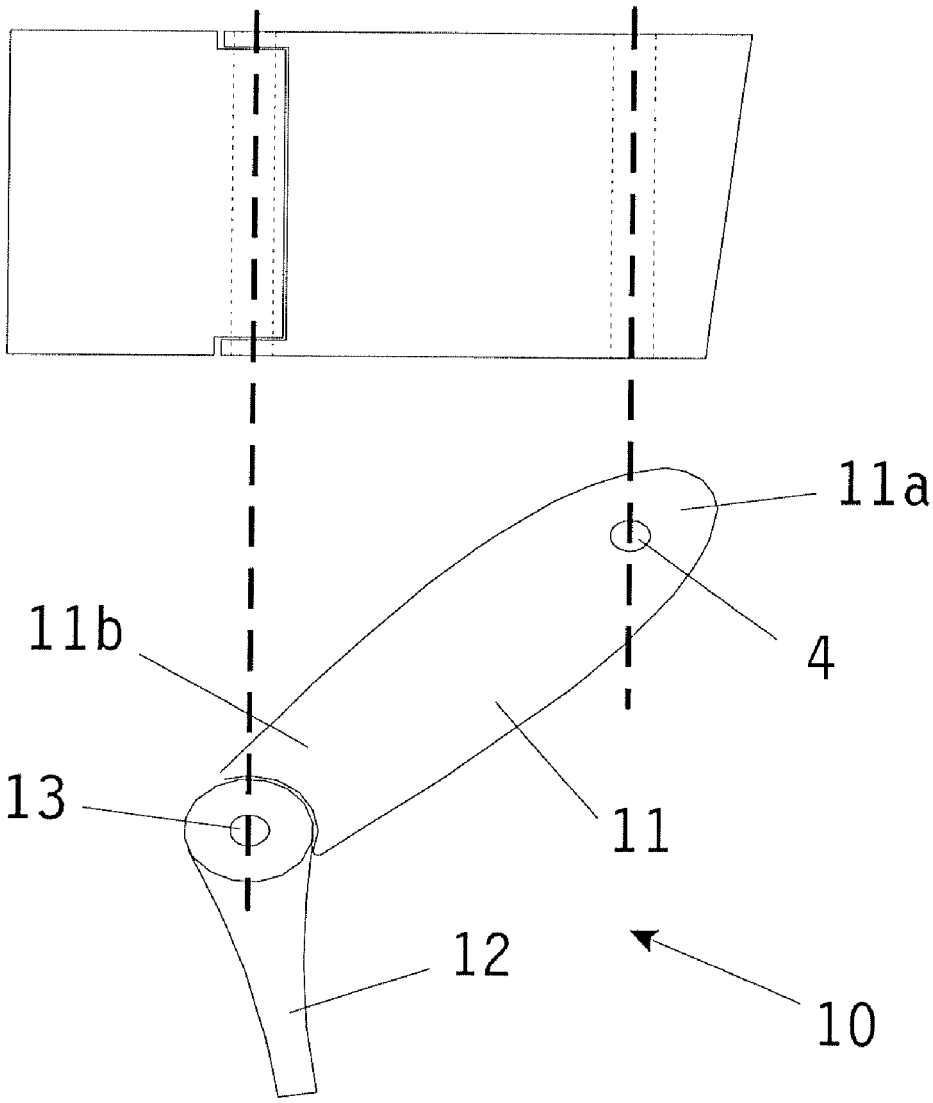
FIG. 3 shows a first embodiment of a stabilisation element according to the invention.

One embodiment of such a stabilization element is shown in FIG. 3. The stabilization element 10 that is shown therein is composed of a main element 11 of elongated shape, which is movable about an axis of rotation 4 with respect to the ship 1 with a first end 11*a*, similar to the situation that is shown in FIG. 1.

As is clearly shown in FIG. 3, the main axis of rotation 4 and the sub-axis of rotation 13 are spaced some distance apart. The sub-axis of rotation may extend parallel to the main axis of rotation, although this is not necessary. Using the sub-element 12, it is possible to effectively adapt the constructional dimensions of the stabilization element 10 to the stabilization situation in which the stabilization element 10 is to be used.

Figure 4:
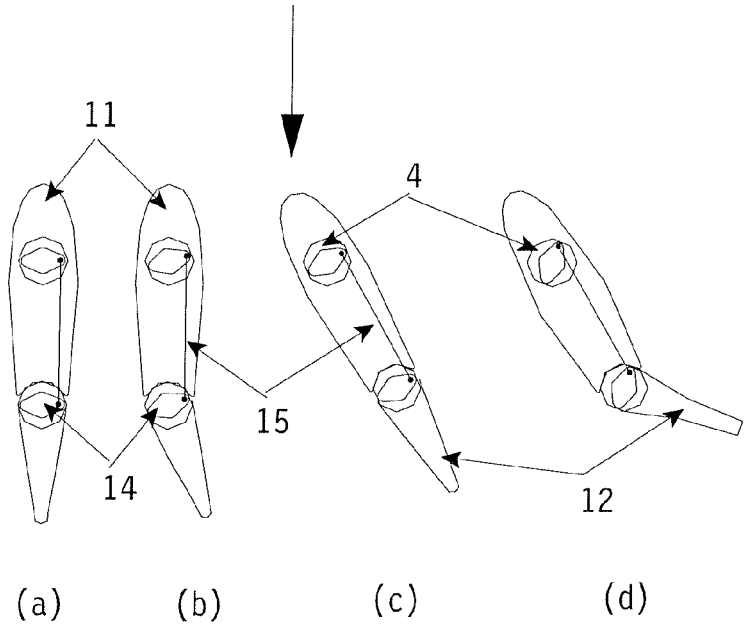
FIGS. 4 and 5 are detail views of the embodiment that is shown in FIG. 3.
Figure 5:
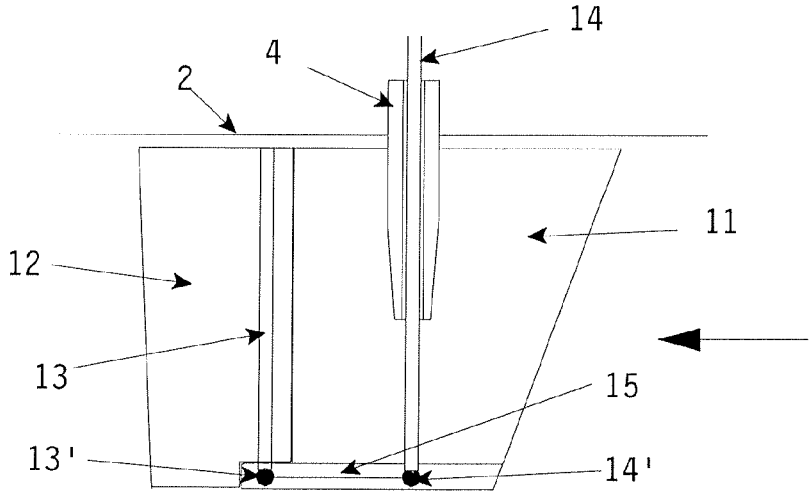

As is shown in FIGS. 4 and 5, the sub-element 12 can be actively rotated with respect to the main element 11 in one embodiment. To that end, the shaft 4 on which the main element 11 is mounted is of hollow construction, and a drive shaft 14 extends through the hollow shaft 4. The rotary shaft 4 and the drive shaft 14 both extend through the ship's hull, being connected in the interior of the ship with, respectively, rotation means 9 for rotating the rotary shaft 4 (and the main element 11 and the sub-element 12) and drive means such as is described hereafter for driving the drive shaft 14 that extends through the hollow rotary shaft.

The drive shaft 14 is connected with its free end 14' to a transmission 15, which transmits the rotation that is imparted to the drive shaft 14 by the drive means to the free end 13' of the sub-shaft 13. As is shown in the partial views (a)-(d) of FIG. 4, the transmission 15 may consist of a linkage, which transmits the rotation of the drive shaft 14 to the sub-shaft 13 by making use of a lever principle, thus effecting a rotation of the sub-element 12 with respect to the main element 11, independently of the rotation imparted to the main element 11 by the rotary shaft 4.

Since the sub-element 12 is driven independently of the rotary main element 11, it is possible to change the Aspect Ratio (AR) of the stabilization element 10 in an effective manner in dependence on the desired stabilization action that the stabilization element 10 is to carry out in order to oppose or damp the ship's roll while the ship is stationary or while the ship is sailing.

Figure 6:
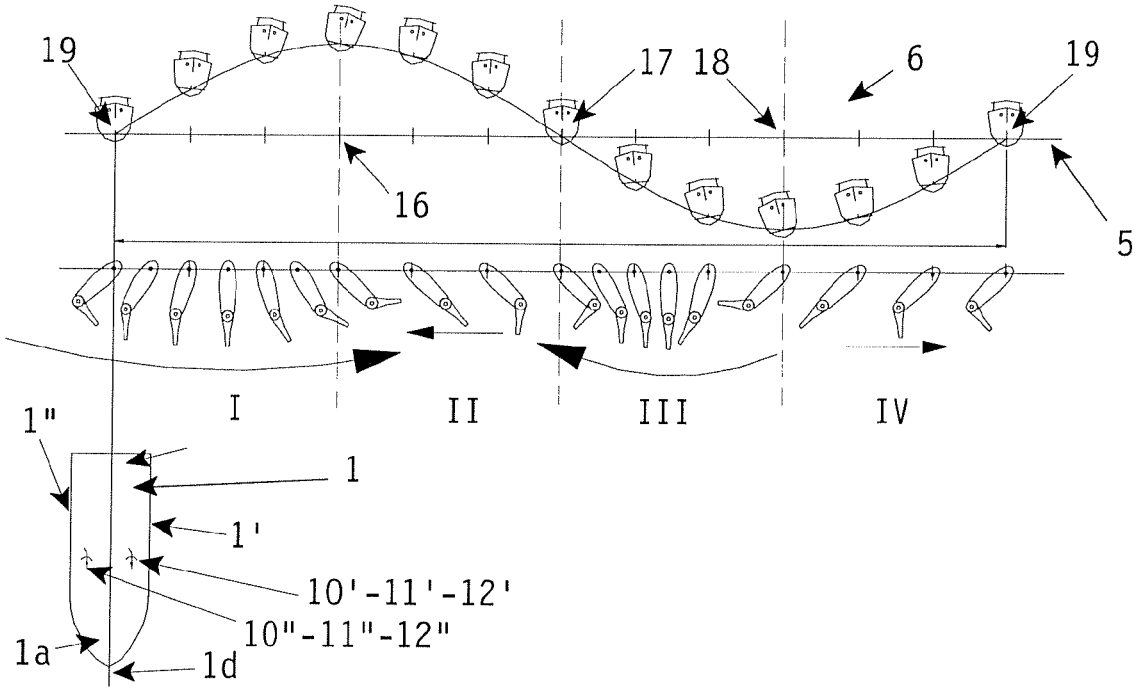
FIG. 6 shows the stabilisation principle of the active stabilisation system according to the invention.

FIG. 6 shows the stabilization principle of the active stabilization system according to the invention with a stationary ship 1, where the sensor means 8, as described above in reference to those of the prior art, and the rotation means 9, also as described above, are shown schematically.

As a result of the wave motion, a ship 1 undergoes a reciprocating (harmonic) rolling motion about its longitudinal axis 1*d* with a maximum heel toward port (indicated at 16) and toward starboard (indicated at 18). The heel or inclination of the ship is minimal in the positions indicated at 19 and 17. At the points of maximum heel 16 and 18 (port side 1' and starboard side 1", respectively), the ship has a rate of roll that equals zero (phase I), whilst the maximum rate of roll during the rolling movement from port 1' to starboard 1" (from position 16 to position 17 and onwards to position 18) is reached at the point of equilibrium 17 (phase II).

The rate of roll of the ship will decrease during the movement of the ship from the point of a equilibrium 17 to the starboard side, until the rate of roll of the ship equals zero again (phase III) at the point of maximum heel of the ship to starboard 1" (position 18). From said position 18, the ship 1 will roll back to port 1', reaching its maximum rate of roll again at the point of equilibrium 19 (phase IV). This rate of roll will decrease as the ship further heels over to port 1', reaching a value that equals zero (phase I) again at the point of maximum heel 16 to port.

The ship 1 is provided with at least one stabilization device according to the invention both on the port side 1' and on the starboard side 1". Alternatively, the ship 1 may be provided with more than one stabilization device on either side thereof. Each stabilization device comprises a stabilization element 10' (10") consisting of a main element 11' (11") and a sub-element 12' (12"). FIG. 6 shows a stabilization element 10' (10") as shown in FIGS. 3-5.

One stabilization device according to the invention, or both, can be controlled and activated during the phases I-II-III-IV for damping the ship's roll 6.

During phase I of the rolling movement 6 of the ship, the ship 1 heels over to port 1', which downward movement is offset by an counter moment in upward direction on the port side 1' and by a counter moment in downward direction on the starboard side 1". To that end, a downward rotary motion about axis of rotation 4' in the direction of the bottom of the sea is imparted to the stabilization element 10 on the port side 1'. On the starboard side 1", the stabilization element 10 is rotated in upward direction toward the water surface 5 about the axis of rotation 4".

The sub-element 12' (12") is held in line with the main element 11' (11") during the larger part of the rotary motion during phase I. The stabilization element 10' (10") obtains a low AR, which, as already explained before, is the most effective ratio for damping the roll of a stationary ship. The downwardly rotating main element 11' on the port side 1' and the upwardly rotating main element 11" on the starboard side 1" displace water in downward (and upward, respectively) direction, resulting in an upward (and downward, respectively) reaction force and counter moment on the ship, as a result of which the downward roll to port is damped.

At the end of phase I, the rotary motion of the main element 11' (11") is no longer directed downwards (upwards), so that the element no longer displaces water downwards (upwards) in an effective manner. The damping of the ship's roll through rotation of the main element 11' (11") has "worn off". To be able to damp the ship's rolling movement at the end of phase I yet, the sub-element 12' (12") is rotated further downwards (upwards) via the drive means, for example, drive means 60 as discussed hereinafter, the drive shaft 14 and the transmission 15, so that the sub-element 12' (12") is no longer in line with the main element 11' (11") at the end of phase I, but extends at an angle thereto.

An additional downward (upward) counter force is exerted on the water by the moving sub-element 12' (12"), which makes it possible to additionally damp the downward roll of the ship to port.

While the main element 11' (11") is at the end of its downward (upward) stroke at the end of phase I, and consequently is no longer able to generate an effective counter moment for damping the ship's roll, such an effective counter moment can on the other hand be generated by means of the sub-element 12' (12").

During phase II of the ship's roll 6, the ship 1 rolls about its longitudinal axis 1*d* towards starboard 1", with the rate of roll of the ship gradually increasing in the direction of position 17. During phase II, the weight of the ship generates a turning moment about the longitudinal axis 1*d*, which moment is so large that a lifting moment generated by the stabilization elements 10' (10") will by no means suffice to counter this moment. During phase II, the sub-element 12' (12") is returned to an advantageous starting position with respect to the main element 11' (11"), as shown in FIG. 6, for damping the ship's rolling motion during phase III.

The ship's roll toward starboard 1" (phase III) must be compensated by a downward (upward) movement of the stabilization element 10' (10") on the port side 1' and the starboard side 1", respectively. To achieve the most effective stabilization, the sub-element 12' (12") is held in line with the main element 11' (11") as much as possible so as to obtain a stabilization element 10' (10") having a minimum AR. During phase III, the stabilization elements 10' (10") are capable of "scooping" a maximum amount of water in this position and moving it upwards (downwards), making it possible to generate the most effective reaction force and the resulting lifting moment for opposing the ship's rolling movement toward starboard.

At the end of phase III, the rotary motion of the main element 11' (11") is no longer directed upwards (downwards), so that water is no longer effectively displaced in upward (downward) direction. The damping of the ship's roll through rotation of the main element 11' (11") has "worn off". Analogously to the description of phase I, an additional stabilizing action can be obtained by imparting an upward (downward) movement to the sub-element 12' (12"), so that the sub-element 12' (12") will take up an angle with respect to the main element 11' (11"), as is shown in FIG. 6.

At the end of phase III, the ship 1 heels over maximally toward starboard 1" (indicated at 18), after which the ship 1 will roll back toward port 1' during phase IV. The rate of roll of the ship gradually increases while the ship rolls towards position 19, so that the stabilization elements 10' (10") will have little effect. The weight of the ship generates a turning moment about the longitudinal axis 1*d*, which moment is so large that a lifting moment generated by the stabilization elements 10' (10") will by no means suffice to counter this moment.

During phase IV, the sub-element 12' (12") is merely returned to an advantageous starting position with respect to the main element 11' (11"), as shown in FIG. 6, for damping the ship's rolling motion during phase I. During phase I, the ship's roll is damped or opposed in the manner described above.

Figure 7A:
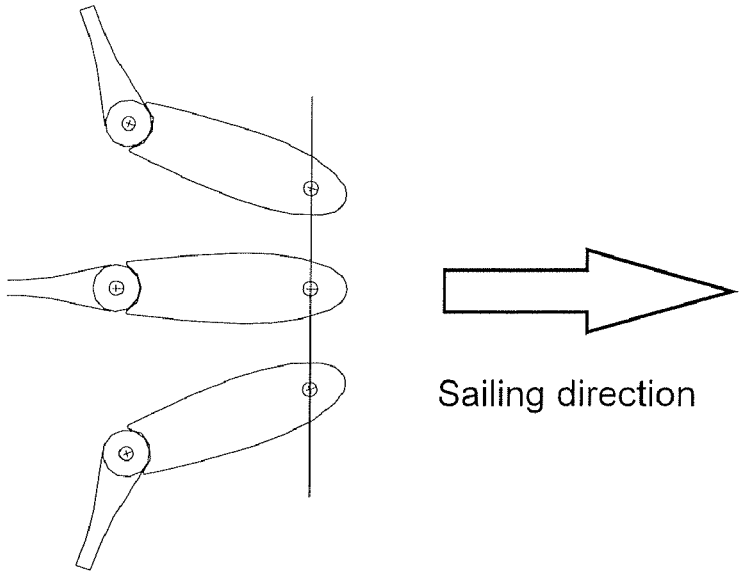
FIGS. 7A and 7B show other possible stabilisation principles of the active stabilisation system according to the invention.
Figure 7B:
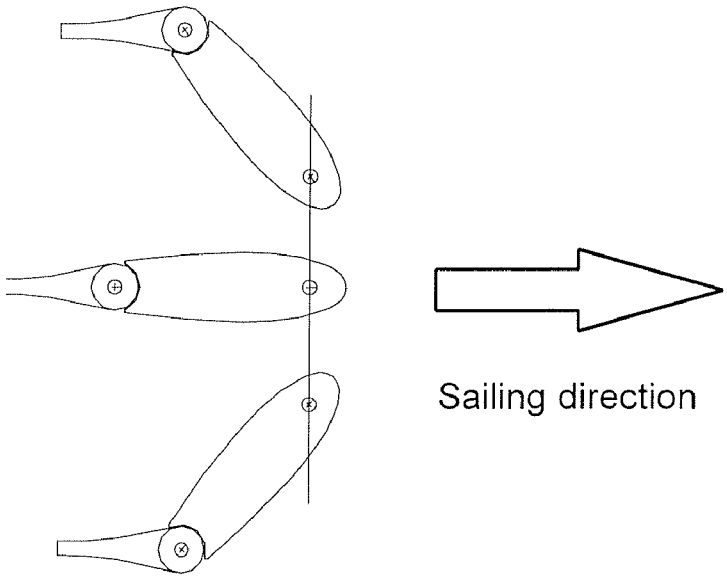

FIGS. 7A and 7B show two other stabilization principles of the active stabilization system according to the invention. While FIG. 6 shows the stabilization principle of the active stabilization system according to the invention with a stationary ship, FIGS. 7A and 7B show the stabilization principle of the active stabilization system according to the invention with a sailing ship, with FIG. 7A relating in particular to a ship sailing at low speeds and FIG. 7 relating to the stabilization principle with the ship sailing at high speed (for example cruising speed).

Referring to that which is shown in FIGS. 2A and 2B, in the stabilization principle as shown in FIG. 7A the sub-element 12 is so controlled with respect to the main element 11 that, in particular at low speeds, the stabilization element 10 (composed of the main element 11 and the sub-element 12) has a maximum damping effect on the roll that the ship undergoes at low speeds as well. The water flowing past is additionally deflected by the adjusted sub-elements 12, as a result of which the so-called lifting action of the water flowing past is enhanced and consequently the reaction force exerted on the water by the stabilization element 10 for correcting the ship's roll is most effective. Especially at low speeds, a stabilization element 10 having a low AR value is created.

FIG. 7B, on the other hand, shows the stabilization principle of the active stabilization system according to the invention with a ship sailing at a high speed or cruising speed. To generate a minimum moment in order to enable quick rotation of the stabilization element 10 about the shaft 4 which extends along the axis of rotation, using little energy/power, it is desirable to realize a stabilization element 10 having a high AR value at high speeds. The sub-element 12 is to that end controlled in such a manner during operation that it will extend or be oriented more or less parallel to the direction of flow at all times, and consequently does not contribute to the stabilizing effect that the stabilization element 10 can have on the ship's roll. In some cases, the flow under the ship is oriented altogether different from the direction of travel of the ship.

In this operating condition (FIG. 7B), only the main element 11 contributes towards the creation of a reaction force on the water for the purpose of opposing or damping the ship's roll.

The stabilization principle or the stabilization method according to the invention utilizes the speed of the ship 1. Measuring the speed enables the control electronics to determine whether the sub-element 12 must actively contribute towards the damping of the ship's roll (FIG. 7A) or whether a position parallel to the water flowing past must be imparted to said sub-element at all times, as in FIG. 7B.

Figure 8:
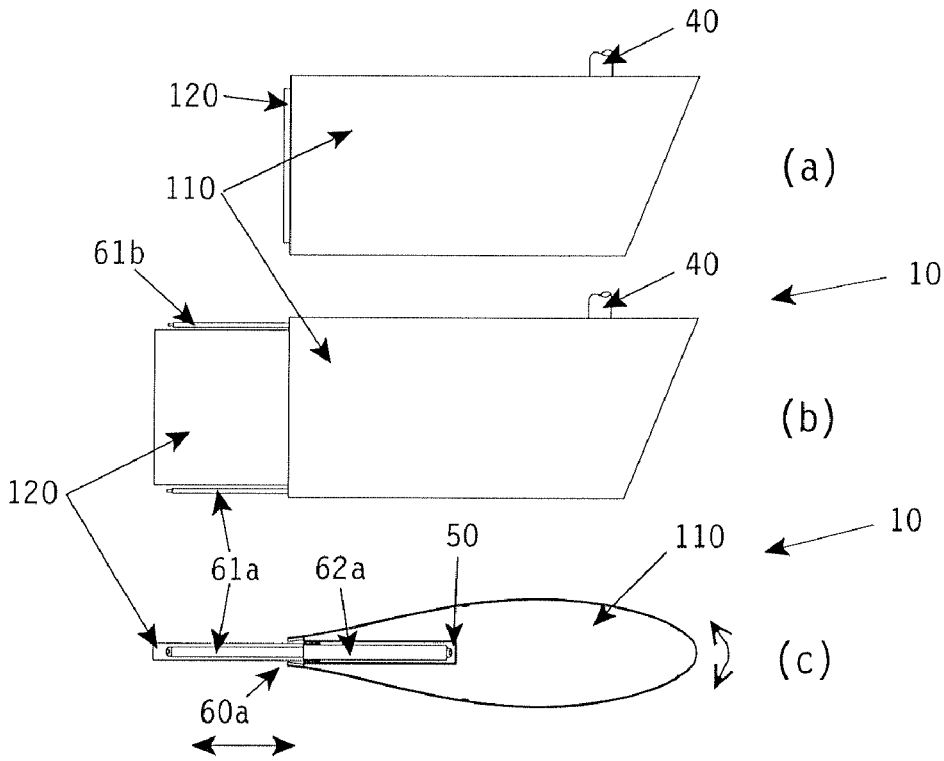
FIG. 8 shows a second embodiment of a stabilisation element according to the invention.

FIG. 8 shows another embodiment of a stabilization element 10 according to the invention. Also in this case, the stabilization element 10 is built up of a main element 110, which is capable of reciprocating rotating movement about an axis of rotation 40 in dependence on the ship's rolling movements as sensed. The sub-element according to the invention is indicated at 120 in this figure, it can be slidably accommodated in a recess 50 formed in the main element 110 (see partial view (c)).

In view (a) of FIG. 8, the sub-element 120 is accommodated in fully telescoped position in the space of 50 in the main element 110, so that the stabilization element 10 thus obtained has a high Aspect Ratio (AR). Such a stabilization element has a low turning moment, therefore, which makes it very suitable for use while the ship is sailing.

View (b) shows the sub-element 120 in the extended position, as a result of which the stabilization element 10 has a low Aspect Ratio (AR). This enables the stabilization element 10 to "scoop" a large amount of water, which makes it very suitable for damping the roll of a stationary ship.

The sub-element 120 is accommodated in guides (not shown) in the space 50 in order to enable the sub-element 120 to telescope in and out as shown in views (a) and (b). The sub-element 120 can be moved in and out along said guides by suitable drive means 60, for example in the form of piston-cylinder combinations 60*a* and 60*b*, respectively, mounted on either side of the sub-element 120, near each guide.

Each piston-cylinder combination 60*a*-60*b* comprises a cylinder 62*a*-62*b* and a piston 61*a*-61*b* connected to the sub-element 120. The piston 61*a*-61*b* can be made to carry out a stroke by adding a suitable pressurised medium (air, water or, for example, oil), causing the sub-element 120 to move out of the space 50 along the guides and thus effect a random extension of the main element 110 in dependence on the desired reaction force or lifting moment that the stabilization element 10 is to generate for damping the ship's roll.

Figure 9:
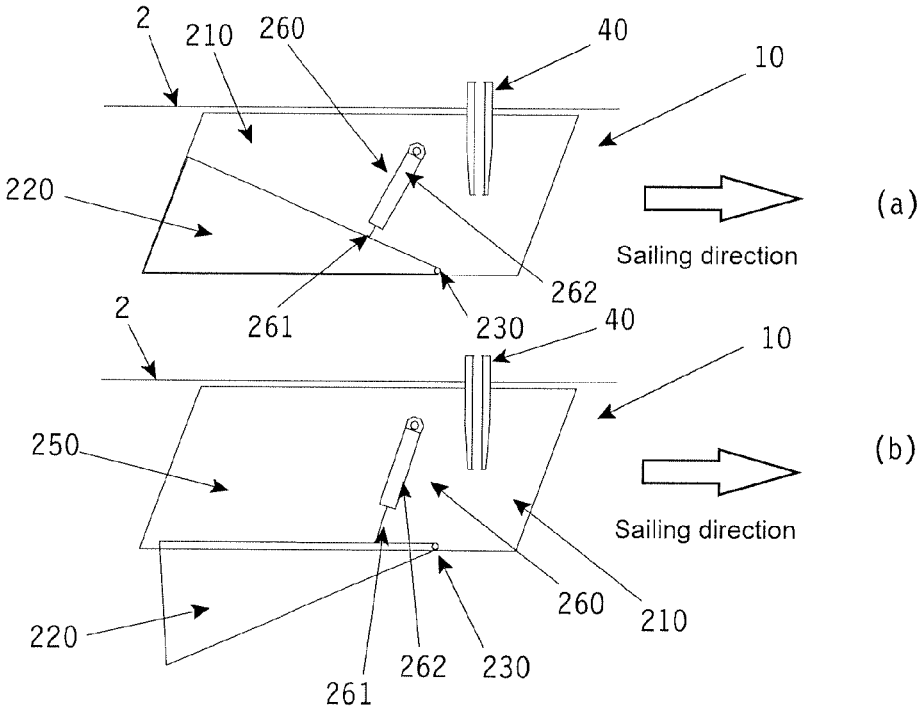
FIG. 9 shows a third embodiment of a stabilization element according to the invention.

In FIG. 9 a third embodiment of a stabilization element according to the invention is disclosed. The active stabilization device 10 according to FIG. 9 exhibits a main element 210, which is capable of reciprocating rotation movement about an axis or shaft of rotation 40 in dependence on the ship's rolling movements as sensed. The sub-element according to the invention is indicated with reference number 220, which is pivotably connected with the main element 210 and which is accommodated in a recess or space 250, which is formed in the main element 210.

The sub-element 220 is pivotable around a pivot point 230. In view (a) of FIG. 9 the sub-element 220 is fully accommodated within the space 250 in the main element 210, so that the stabilization element 10 has a high Aspect Ratio (AR). Such a stabilization element has a low turning moment, and it is very suitable for using while the ship is sailing.

View (b) shows the sub-element 220 in extended pivoted position, wherein the sub-element is pivoted in outward position around pivot point 230 in a direction substantially transverse to the longitudinal direction of the ship (or transverse to the sailing direction of the ship). In this situation the stabilization element 10 has obtained a low Aspect Ratio (AR) and is able to "scoop" a large amount of water, making it very suitable for damping the roll of a stationary ship laying at harbour.

For displacing the sub-element 220 between the positions shown in views (a) and (b) drive means 260 are accommodated within the main element 210, for example in the form of a piston-cylinder combination consisting of a cylinder 262 and a piston 261 connected to the sub-element 220. In a similar manner as described in relation with the embodiment shown in FIG. 8, the piston 261 can carry out a stroke by feeding a suitable pressurized medium (air, water, or, for example, oil) towards the cylinder 262, causing the sub-element 220 to pivot around its pivot point 230 resulting in a displacement out of the space 250. In dependence of the roll movements of the ship being sensed, a random extension of the sub-element 220 relative to the main element 210 can be set with the drive means 260, thereby creating the desired reaction force or lifting moment, which has to be created by the stabilization element 210 for damping the roll movements of the ship.

Figure 10:
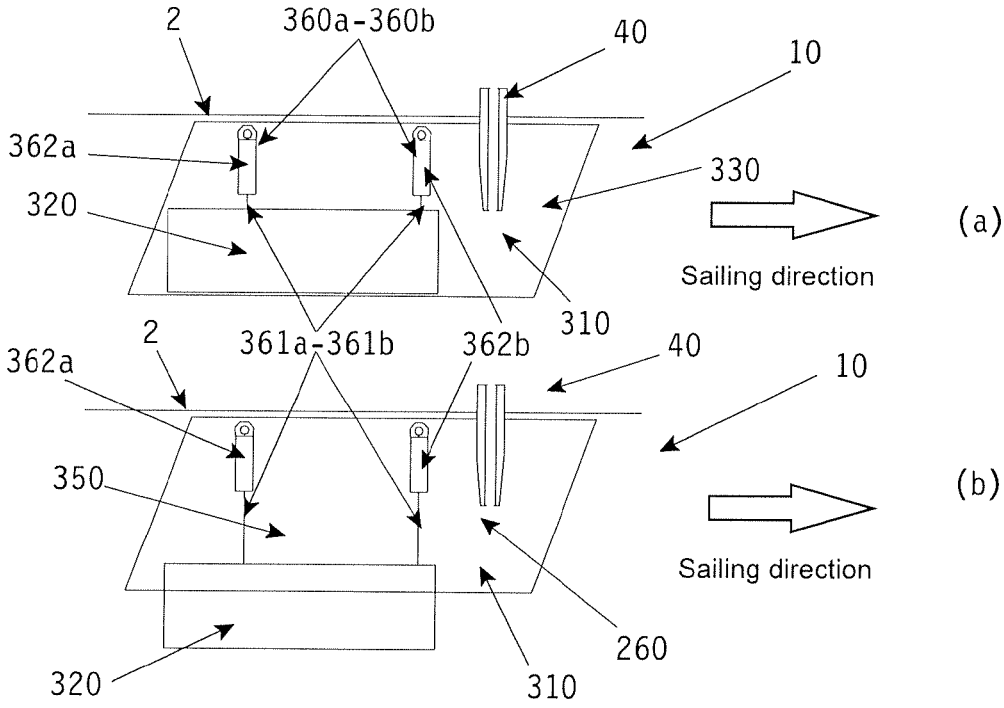
FIG. 10 shows a fourth embodiment of a stabilization element according to the invention.

In FIG. 10 a fourth embodiment is disclosed wherein the main element 310 is provided with a space 350 wherein the sub-element 320 is slidably accommodated. The sub-element 320 can be displaced in a direction transverse to the longitudinal access of the ship (or transverse to the sailing direction) using suitable drive means 360*a*-360*b*. Also in this embodiment the drive means 360*a*-360*b* are constructed as suitable piston-cylinder combinations, each comprising a cylinder 362*a* (362*b*) and a piston 361*a* (361*b*) for displacing the sub-element 320 in or out of the space 350 of the mean element 310, as clearly shown in views (a) and (b) of FIG. 10 respectively.

The drive means 360*a*-360*b* can be operated in a similar manner as the drive means 260 of FIG. 9 and the drive means 60*a*-60*b* of the embodiment shown in FIG. 8. The embodiment of FIG. 10 has a great similarity with the embodiment of FIG. 8, whereas FIG. 8 the sub-element 120 can be displaced in a direction parallel to the longitudinal direction of the ship, whereas in FIG. 10 the displacement of the sub-element 320 takes place in a direction transverse to the longitudinal direction of the ship.

As clearly depicted in FIGS. 9 and 10, the access or shaft 40, on which the stabilization element 10 is mounted is made hollow. The hollow rotation shaft 40 allows the feeding of supply lines for, for example, pressurized medium towards the drive means accommodated in the main element 10 for displacing or pivoting the sub-element, thus changing the Aspect Ratio (AR), making the stabilization element 10 according to the invention highly suitable to be used when the ship is sailing (high Aspect Ratio) or when the ship is at harbour (low Aspect Ratio).

In another embodiment, the drive means may be configured as a (screwed) spindle driving mechanism.

Thus the Aspect Ratio of the stabilization element 10 (110-210-310), and consequently also the stabilizing counter action of the stabilization element 10 (110-210-310) on the ship's roll, can be adapted in a simple manner by moving the sub-element 12 (120-220-320) in and out in a variable manner during the rotary motion of the sub-element 12 (120-220-320) about the axis of rotation 4.

It will be apparent that the active stabilization system according to the invention provides a more effective stabilization technique for opposing a ship's rolling movements both while the ship is stationary and while the ship is sailing (at low speed and at high speed). The simple yet robust construction and driving arrangement of the sub-element with respect to the main element enable the active stabilization system according to the invention to realize a stabilization effect on the rolling movements being sensed in a quick and simple manner, but above all the system can be adjusted very quickly for stabilizing the ship's roll while the ship is sailing at low speed or at high speed or while the ship is stationary.

The invention claimed is:

1. An active roll stabilization system for ships at anchor, comprising at least one stabilization element extending below the water line, which is mounted on a rotary shaft that extends through and has a fixed orientation relative to the ships hull, sensor means for sensing the ship's movements at anchor and delivering control signals on the basis thereof to rotation means for rotating the rotary shaft for the purpose of damping the ship's movements that are being sensed by means of the stabilization element, wherein the stabilization element is provided with a sub-element that is movable with respect to the rotating stabilization element as part of the stabilization action based on the control signals delivered by said sensor means thereby imparting an additional lifting moment to the ship via the stabilization element for the purpose of damping the ship's movements that are being sensed while the ship is at anchor.

2. An active stabilization system according to claim 1, wherein said sub-element is pivotable about a sub-shaft.

3. An active stabilization system according to claim 2, wherein the sub-pivot extends parallel to the rotary shaft.

4. An active stabilization system according to claim 1, wherein the sub-element is slidably accommodated in a space formed in the stabilization element.

5. An active stabilization system according to claim 4, wherein the sub-element is pivotably connected with the stabilization element.

6. An active stabilization system according to claim 4, wherein the sub-element is slidably in a direction parallel to the longitudinal axis of the ship.

7. An active stabilization system according to claim 4, wherein the sub-element is slidably in a direction transverse to the longitudinal axis of the ship.

8. An active stabilization system according to claim 1, wherein the sub-element is capable of movement independently of the rotary movement of the stabilization element.

9. An active stabilization system according to claim 1, wherein the sub-element has a curved shape.

10. An active stabilization system according to claim 1, wherein the sub-element has a wing shape.

11. An active stabilization system according to claim 1, wherein the sub-element is made of a flexible material.

12. An active stabilization system according to claim 1, wherein the rotation means comprise at least one piston-cylinder combination, said piston being operably connected to the rotary shaft.

13. An active stabilization system according to claim 12, wherein the rotation means comprise two piston-cylinder combinations, each piston being connected on either side of the longitudinal direction of the rotary shaft to a yoke mounted to the shaft end that extends into the ship's hull.

14. An active stabilization system according to claim 1, wherein drive means are present for driving the sub-element, which drive means are at least partially accommodated in the stabilization element.

15. An active stabilization system according to claim 14, wherein the rotary shaft is of hollow construction, and the drive means also comprise a drive shaft that is carried through said hollow, rotary shaft.

16. An active stabilization system according to claim 15, wherein the drive means comprise a linkage accommodated in the stabilization element, which linkage is connected to the sub-element on the one hand and to the drive shaft on the other hand.

17. An active stabilization system according to claim 14, wherein the drive means comprise at least one extension element accommodated in the stabilization element, which is connected to the sub-element, for extending and retracting the sub-element.

18. An active stabilization system according to claim 17, wherein said extension element forms part of a spindle driving mechanism.

19. An active stabilization system according to claim 17, wherein said extension element forms part of a piston-cylinder combination.

20. An active stabilization system according to claim 1, wherein the position of the sub-element with respect to the stabilization element is adjustable in dependence on the speed of movement of the ship.

21. A ship provided with an active stabilization system according to claim 1.

22. A method for active roll stabilization of ship at anchor through the use of an active stabilization system according to claim 1, which method comprises the steps of:

A) sensing the ship's movements at anchor

B) delivering control signals on the basis thereof for rotating the rotary shaft for the purpose of C) damping the ship's movements that are being sensed by means of the stabilization element by rotating the rotary shaft, the method being further characterized by the steps of:

E) adjusting the position of the sub-element with respect to the stabilization element based on the control signals and imparting an additional lifting moment to the ship via the stabilization element for the purpose of damping the ship's movements at anchor that are being sensed.

* * * * *